US011479927B2

(12) United States Patent
Green

(10) Patent No.: US 11,479,927 B2
(45) Date of Patent: Oct. 25, 2022

(54) ADJUSTABLE CONTROL POINT FOR ASPHALT PAVER

(71) Applicant: Caterpillar Trimble Control Technologies LLC, Dayton, OH (US)

(72) Inventor: Francisco Green, New Carlisle, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 357 days.

(21) Appl. No.: 16/599,825

(22) Filed: Oct. 11, 2019

(65) Prior Publication Data

US 2021/0108378 A1 Apr. 15, 2021

(51) Int. Cl.
*E01C 19/28* (2006.01)
*E01C 19/42* (2006.01)
*E01C 19/41* (2006.01)

(52) U.S. Cl.
CPC ..... *E01C 19/42* (2013.01); *E01C 19/41* (2013.01); *E01C 2301/14* (2013.01)

(58) Field of Classification Search
CPC ..... E01C 19/41; E01C 19/42; E01C 2301/14
USPC ..... 404/72, 75, 84.05–84.5, 118; 701/1–10
See application file for complete search history.

(56) References Cited

U.S. PATENT DOCUMENTS 3,285,148 A * 11/1966 Munyon ..... E01C 19/008 404/84.2
3,997,277 A * 12/1976 Swisher, Jr. ..... E01C 19/4873 404/84.05
4,085,805 A * 4/1978 Hawkins ..... E02F 3/845 172/4.5
5,549,412 A * 8/1996 Malone ..... E01C 19/004 404/84.1
10,428,472 B1 * 10/2019 Worsley ..... E01C 23/07
10,876,259 B2 * 12/2020 Kleinvachter ..... E01C 23/01
2011/0255918 A1 * 10/2011 Worsley ..... E01C 23/07 404/84.1

* cited by examiner

*Primary Examiner* — Raymond W Addie
(74) *Attorney, Agent, or Firm* — Kilpatrick Townsend & Stockton

(57) ABSTRACT

Systems and methods for controlling a construction machine, such as an asphalt paver, having a tractor, an implement coupled to the tractor via at least one tow arm, and a mast. A position sensor mounted to the mast may detect a geospatial position of the mast. An angle sensor may detect at least one angle associated with the mast. A control point may be calculated based on the geospatial position and the at least one angle. The control point may be spatially offset from a vector formed by a lengthwise extension of the mast. The at least one tow arm may be moved based on a comparison between the control point and a target point.

20 Claims, 12 Drawing Sheets

ADJUSTABLE CONTROL POINT FOR ASPHALT PAVER

BACKGROUND

Modern construction machines have dramatically increased the efficiency of performing various construction projects. For example, earthmoving machines employing automatic slope control systems are able to grade a project area using fewer passes than what was previously done manually. As another example, modern asphalt pavers and other road makers have allowed replacement of old roads and construction of new roads to occur on the order of hours and days instead of what once took place over weeks and months. Construction crews also now comprise fewer individuals due to the automation of various aspects of the construction process. Much of the technological advances of construction machines are owed in part to the availability of accurate sensors that allow real-time monitoring of the condition and position of a machine's components and/or the environment surrounding the machine. Despite the improvements in modern construction machines, new systems, methods, and techniques are still needed.

SUMMARY

In a first aspect of the present invention, a construction machine is provided. The construction machine may include a tractor. The construction machine may also include an implement coupled to the tractor via at least one tow arm. The construction machine may further include a mast mounted to the implement or to the at least one tow arm. The construction machine may further include a position sensor mounted to the mast and configured to detect a geospatial position of the mast. The construction machine may further include an angle sensor configured to detect at least one angle associated with the mast. The construction machine may further include one or more processors configured to perform operations including calculating a control point based on the geospatial position and the at least one angle. In some embodiments, the control point is spatially offset from a vector formed by a lengthwise extension of the mast. The operations may also include causing movement of the at least one tow arm based on a comparison between the control point and a target point.

In some embodiments, the construction machine is an asphalt paver. In some embodiments, the implement is a screed. In some embodiments, the angle sensor is mounted to the implement, the at least one tow arm, or the mast. In some embodiments, the at least one angle includes one or both of a pitch angle and a roll angle. In some embodiments, the operations further include receiving user input via a user input device. In some embodiments, the operations further include calculating the target point based on the user input. In some embodiments, the operations further include comparing the control point to the target point. In some embodiments, the operations further include calculating an error based on the comparison between the control point and the target point.

In some embodiments, the at least one tow arm is caused to move based on the error. In some embodiments, the control point is spatially offset from the vector in one or both of a longitudinal direction of the construction machine or a transverse direction of the construction machine. In some embodiments, causing the movement of the at least one tow arm includes generating and sending a control signal to one or both of a left tow point cylinder coupled to a left tow arm of the at least one tow arm and a right tow point cylinder coupled to a right tow arm of the at least one tow arm. In some embodiments, the left tow arm is coupled to the left tow point cylinder at a forward end of the left tow arm and to the implement at a rear end of the left tow arm. In some embodiments, the right tow arm is coupled to the right tow point cylinder at a forward end of the right tow arm and to the implement at a rear end of the right tow arm.

In a second aspect of the present invention, a machine control system is provided. The machine control system may include a position sensor configured to be mounted to a mast of a construction machine and to detect a geospatial position of the mast. The machine control system may also include an angle sensor configured to detect at least one angle associated with the mast. The machine control system may further include one or more processors configured to perform operations including calculating a control point based on the geospatial position and the at least one angle. In some embodiments, the control point is spatially offset from a vector formed by a lengthwise extension of the mast. In some embodiments, the operations also include causing movement of at least one tow arm of the construction machine based on a comparison between the control point and a target point.

In some embodiments, the construction machine is an asphalt paver. In some embodiments, the angle sensor is configured to mount to the mast, the at least one tow arm, or an implement of the construction machine. In some embodiments, the at least one angle includes one or both of a pitch angle and a roll angle. In some embodiments, the operations further include receiving user input via a user input device. In some embodiments, the operations further include calculating the target point based on the user input. In some embodiments, the operations further include comparing the control point to the target point. In some embodiments, the operations further include calculating an error based on the comparison between the control point and the target point. In some embodiments, the at least one tow arm is caused to move based on the error. In some embodiments, the control point is spatially offset from the vector in one or both of a longitudinal direction of the construction machine or a transverse direction of the construction machine.

In a third aspect of the present invention, a method is provided. The method may include detecting, by a position sensor mounted to a mast of a construction machine, a geospatial position of the mast. The method may also include detecting, by an angle sensor, at least one angle associated with the mast. The method may further include calculating a control point based on the geospatial position and the at least one angle. In some embodiments, the control point is spatially offset from a vector formed by a lengthwise extension of the mast. The method may further include causing movement of at least one tow arm of the construction machine based on a comparison between the control point and a target point.

In some embodiments, the at least one angle includes one or both of a pitch angle and a roll angle. In some embodiments, the method further includes receiving user input via a user input device. In some embodiments, the method further includes calculating the target point based on the user input. In some embodiments, the method further includes comparing the control point to the target point. In some embodiments, the method further includes calculating an error based on the comparison between the control point and the target point. In some embodiments, the at least one tow arm is caused to move based on the error.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

Figure 1:
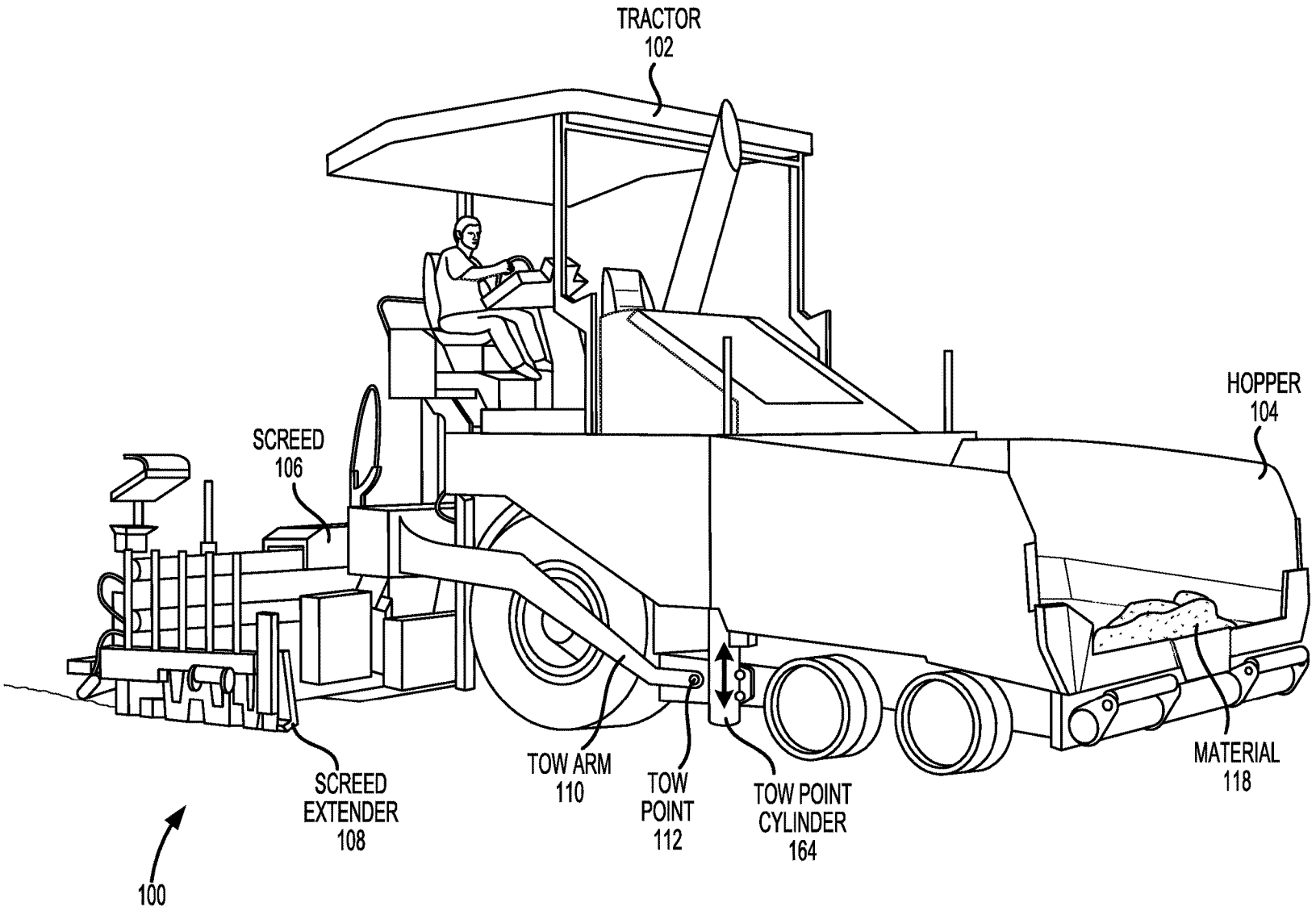
FIG. 1 illustrates a perspective view of an asphalt paver.

In the appended figures, similar components and/or features may have the same numerical reference label. Further, various components of the same type may be distinguished by following the reference label with a letter or by following the reference label with a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION

A control system for a construction machine may include a control scheme that causes the machine's physical components to move in such a way that a control point, or reference point, is driven toward a target point, thereby decreasing the error between them. For example, a control point may be the elevation of the bottom edge of a blade of a bulldozer and the target point may be the desired elevation of the blade. The control system may calculate a difference between the two elevations (e.g., the error), and may cause the blade to be moved in such a way that the difference decreases. As another example, a control point may be the geospatial position of a center region of a motor grader and the target point may be a desired path of travel for a particular grading project. The control system may calculate a distance between the geospatial position and the desired path, and may cause the motor grader to steer its wheels to decrease the distance and better align the motor grader with the desired path.

For an asphalt paver, a control scheme may be employed to move the machine's tow arms to ensure that a desired mat thickness is achieved. For example, by lifting one or both of the tow arms at their corresponding tow points, the angle of attack beneath the screed is increased, which causes the amount of asphalt passing under the screed to increase, thereby increasing the mat thickness. One approach to determine the amount of raising or lowering that should be applied to the tow points is through a comparison of a control point and a target point. In some instances, the control point may be set at a position along a bottom surface of the screed, and the target point may be a desired elevation for that position on the screed. Alternatively, the control point may be set at other locations on the screed, the tow arms, or at the tow points themselves.

Various sensors mounted to the asphalt paver may assist in the calculation of the control point during operation of the asphalt paver. For example, position sensors may be used to detect geospatial positions of various components of the asphalt paver, while angle sensors may be used to detect angles or orientations of those components. A position sensor may detect a one-dimensional (1D) geospatial position (e.g, elevation), a two-dimensional (2D) geospatial position (e.g., latitude and longitude), and/or a three-dimensional (3D) geospatial position (e.g., latitude, longitude, and elevation) for a particular component. In contrast, an angle sensor may detect a roll angle (with respect to a longitudinal axis), a pitch angle (with respect to a transverse axis), and/or a yaw angle (with respect to a normal axis) associated with a particular component.

In some instances, it may be possible to mount a position sensor at the same position as the control point. However, because position sensors often rely on the reception of satellite signals or on establishing a line of sight with a nearby laser transmitter, position sensors are more effective when mounted at higher positions on the asphalt paver, such as on the roof of the tractor or on top of a mast. To translate from a detected geospatial position of the higher-positioned position sensor to the lower-positioned control point, an angle sensor may be used to calculate a relevant angle linking the two, such as a pitch angle or a roll angle associated with the mast to which the position sensor is mounted.

While setting the control point near the rear of the asphalt paver, such as on the screed, can result in accurate paved surfaces, the overdrive of the hydraulics can also cause significant ripples. The is due to the difference between the target point and the control point experiencing little change when the hydraulics are actuated. Most of the relative movement between the target point and the control point only occurs later as the machine pulls forward and the screed rides over the surface of the mat which has been laid. This means that the hydraulics will over drive the angle of attack for the screed material to attempt to move the control point to correct elevation quickly. The result is that a more accurate elevation is obtained, but that overdrive with the hydraulics creates little ripples in the surface. Therefore, it can be advantageous to set the control point more forward from the screed, resulting in less overdrive of the hydraulics and a smoother surface, but with somewhat less accuracy.

Embodiments of the present invention relate to systems, methods, and other techniques for controlling an asphalt paver using control point that is not restricted to a surface or a region of the asphalt paver and that may be adjusted in accordance with a user-specified level of smoothness and/or accuracy. To accomplish such control of the asphalt paver, a control system may be implemented that includes a position sensor that detects a geospatial position of a mast and an angle sensor that detects an angle associated with the mast. Both sensors feed data to a control box that uses the data to calculate a control point and a target point, and thereafter causes movement of the asphalt paver's tow arms based on the comparison.

FIG. 1 illustrates a perspective view of an asphalt paver 100, according to some embodiments of the present invention. Asphalt paver 100 is a type of construction machine used to lay asphalt on roads, bridges, parking surfaces, and the like. The term "construction machine" as used herein may refer to asphalt paver 100 or to any one of a number of different types of construction machines, including pavers (e.g., concrete, asphalt, slipform, vibratory, etc.), graders, compactors, excavators, scrapers, loaders, etc., each of which may have components similar to those described in reference to asphalt paver 100.

Asphalt paver 100 may include a tractor 102 with wheels, axles, tracks, and/or a gasoline-, diesel-, electric-, or steam-powered engine for providing power and traction to enable asphalt paver 100 to drive along a desired path, often at a constant speed. Tractor 102 may include a cab in which one or more operators of asphalt paver 100 may control the construction machine using various input devices such as computers, levers, switches, buttons, pedals, etc. Input devices may alternatively or additionally be located at other locations throughout asphalt paver 100. Asphalt paver 100 may include a hopper 104 mechanically coupled to (or integrated with) tractor 102. A material 118 to be laid (e.g., asphalt) may be added to hopper 104 by a dump truck or a material transfer device while asphalt paver 100 is stationary or during operation of asphalt paver 100, such that material 118 may be added to hopper 104 concurrently with moving and laying material 118.

Asphalt paver 100 may include a screed 106 that is mechanically coupled to tractor 102 via one or more tow arms 110. The term "implement" as used herein may refer to screed 106 or to any one of a number of different types of implements that may be dragged behind or pushed in front of a construction machine. Screed 106 may receive material 118 from hopper 104 and spread it over the width of screed 106. Material 118 may pass through an auger that places material 118 in front of a middle region of screed 106. In some embodiments, it is desirable to provide a smooth uniform surface of material 118 behind screed 106, which may be achieved by causing screed 106 to pass over material 118 thereby raising screed 106 above the ground. Using tow arms 110 controlled by tow point cylinders 164, a cross slope associated with screed 106 (i.e., the angle formed by screed 106 with respect to the transverse direction) may be adjusted by a control system to improve the smoothness of the laid asphalt.

The width of screed 106 may be adjusted by moving (e.g., extending or retracting) a screed extender 108, which may be included on a single side or both sides of screed 106. Screed extender 108 may be extended or retracted from screed 106 in the transverse direction, independent of whether asphalt paver 100 is moving forward. When equipped on both sides of screed 106, screed extenders 108 may double the effective width of screed 106, increasing the efficiency of a paving operation. Movement of screed extender 108 is caused by one or more extender actuators positioned within screed 106. In one particular implementation, an extender actuator may be a hydraulic cylinder. In other embodiments, or in the same embodiments, an extender actuator may comprise any type of hydraulic, pneumatic, electric, magnetic, and/or mechanical actuator. Screed extender 108 may be moved while asphalt paver 100 is stationary, driving forward, accelerating, and/or turning.

The height and cross slope of screed 106 may be adjusted by moving tow arms 110. In some embodiments, movement of tow arms 110 is caused by vertical movement of one or more tow point cylinders 164 coupled to tow arms 110 at tow points 112. In the illustrated embodiment, tow point cylinders 164 are rigidly connected to tow points 112 and tow arms 110 may pivot about tow points 112 such that upward (or downward) vertical movement of tow point cylinders 164 causes upward (or downward) vertical movement of the forward ends of tow arms 110 and rotational movement of tow arms 110. Alternatively or additionally, tow point cylinders 164 may pivot about tow points 112 and tow arms 110 may be rigidly connected to tow points 112 such that upward (or downward) vertical movement of tow point cylinders 164 causes upward (or downward) vertical movement of the forward end of tow arms 110 and rotational movement of tow arms 110. In one particular implementation, tow point cylinders 164 may be hydraulic cylinders. In other embodiments, or in the same embodiments, tow point cylinders 164 may comprise any type of hydraulic, pneumatic, electric, magnetic, and/or mechanical actuators.

Figure 2A:
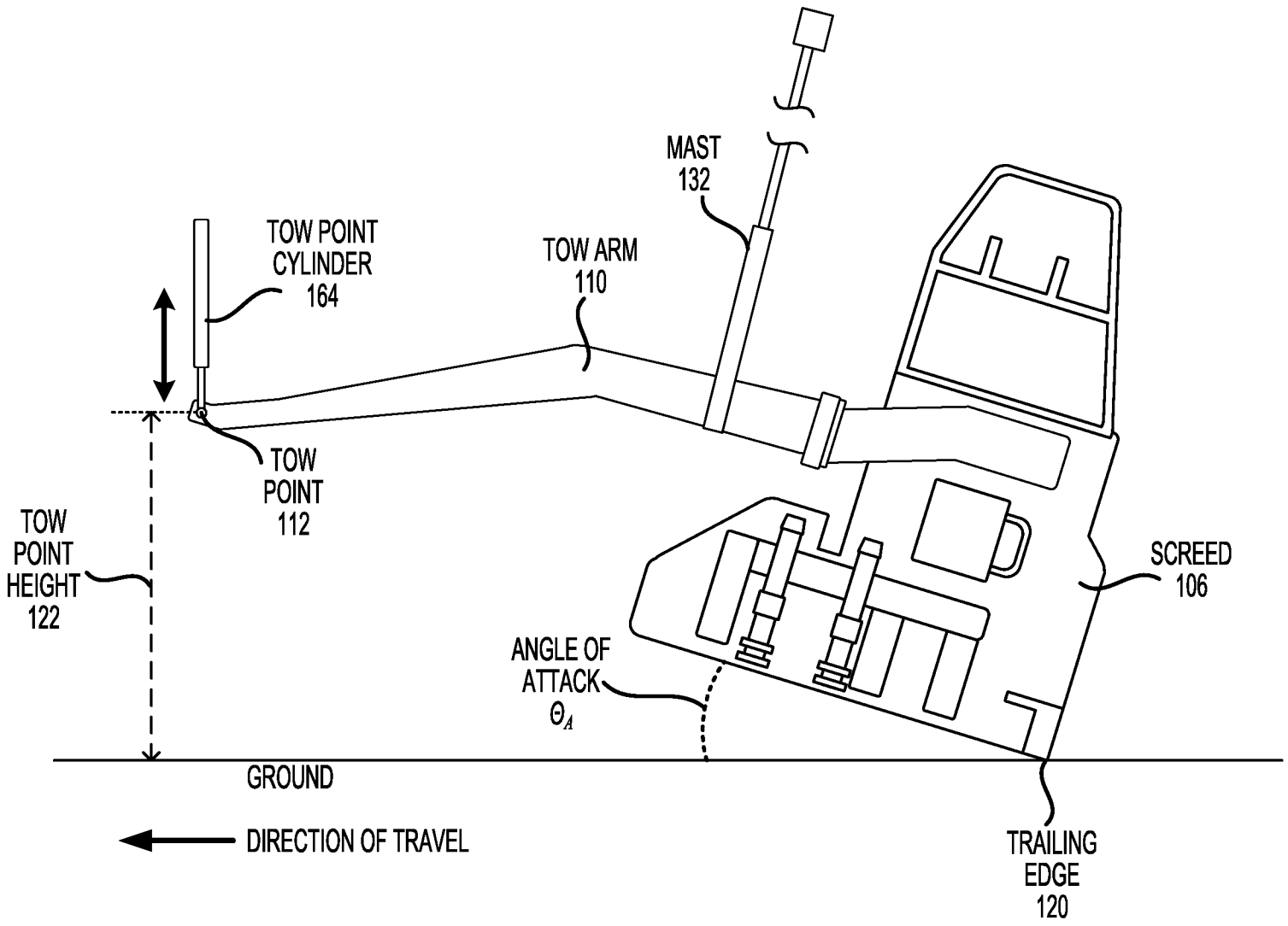
FIG. 2A illustrates a side view of various components of an asphalt paver showing its basic functionality.

FIG. 2A illustrates a side view of various components of asphalt paver 100 showing its basic functionality, according to some embodiments of the present invention. As illustrated, screed 106 may be dragged behind asphalt paver 100 with respect to a direction of travel such that a trailing edge 120 of screed 106 is in physical contact with the ground when material 118 is not being laid. During operation, asphalt paver 100 may vertically raise or lower tow point cylinder 164 so as to set a tow point height 122 defined as the vertical distance between tow point 112 and the ground, and an angle of attack θA defined as the angle formed by the bottom side of screed 106 and the ground. Although a single side of asphalt paver 100 is illustrated in FIG. 2A, asphalt paver 100 may include two tow point cylinders 164, two tow points 112, and two tow arms 110, one on each side of asphalt paver 100 (left and right), which may be adjusted by movement of tow point cylinders 164 to set two tow point heights 122 and two angles of attack θA.

When asphalt paver 100 is stationary, trailing edge 120 remains in contact with the ground and represents the "hinge" line about which any change in tow point height 122 causes screed 106 to rotate, thus changing angle of attack θA relative to the ground surface. Without material 118 in front of screed 106, screed 106 behaves in a similar manner as it travels over flat ground, since trailing edge 120 remains on the ground while angle of attack θA changes as tow point 112 is raised or lowered. In some embodiments, to allow position sensors to be mounted at higher elevations, asphalt paver 100 may include a mast 132 that may be rigidly attached to tow arm 110.

Figure 2B:
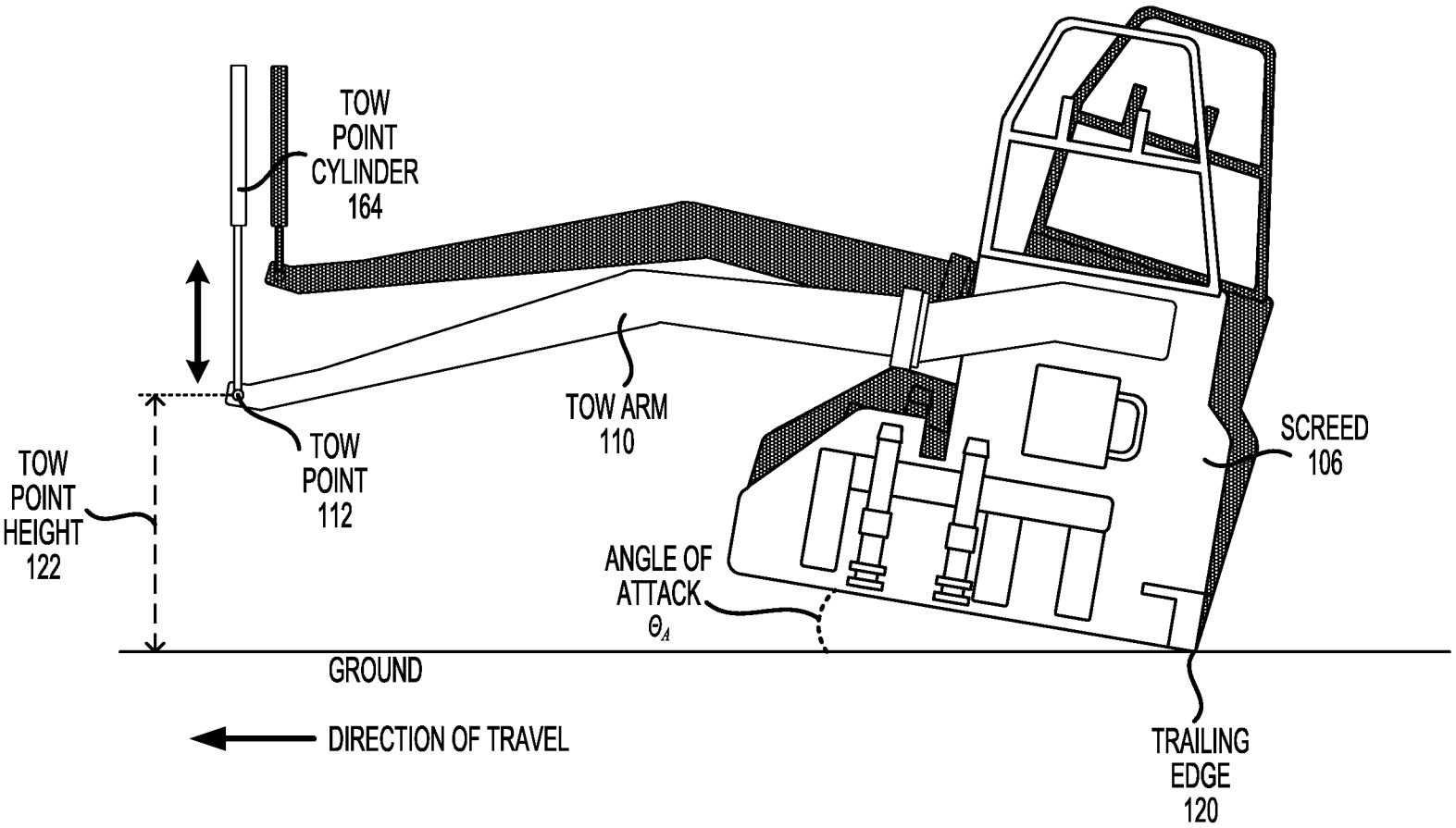
FIG. 2B illustrates a side view of various components of an asphalt paver showing a scenario in which a tow point cylinder is lowered.

FIG. 2B illustrates a side view of various components of asphalt paver 100 showing a scenario in which tow point cylinder 164 is lowered thereby causing both tow point height 122 and angle of attack θA to decrease. A silhouette of the scenario described in FIG. 2A is also illustrated for comparison, with the two scenarios aligned at trailing edge 120 for purposes of clarity.

Figure 2C:
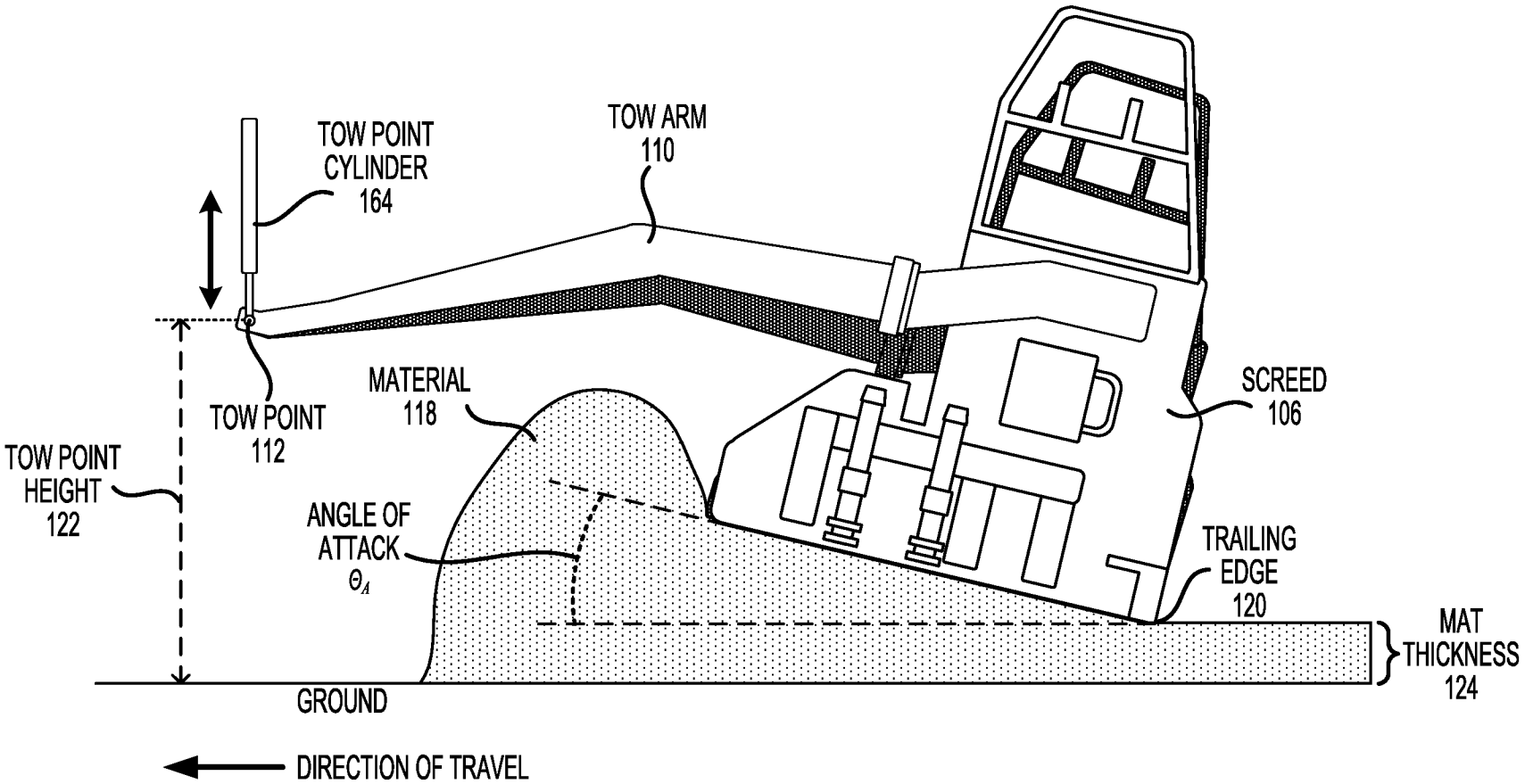
FIG. 2C illustrates a side view of various components of an asphalt paver showing a scenario in which a tow point cylinder remains in a constant position and material is introduced.

FIG. 2C illustrates a side view of various components of asphalt paver 100 showing a scenario in which tow point cylinder 164 remains in a constant position and material 118 is introduced in front of screed 106 thereby causing screed 106 to "ride up" over material 118 to some degree, depending on angle of attack θA, the velocity of asphalt paver 100, the consistency of material 118, the temperature of material 118, the weight of screed 106, among other factors. A silhouette of the scenario described in FIG. 2A is also illustrated for comparison, with the two scenarios aligned at tow point 112 for purposes of clarity. While tow point cylinder 164 and tow point height 122 remain constant, the introduction of material 118 in front of screed 106 causes angle of attack θA to decrease.

If all conditions remain constant (the velocity of asphalt paver 100, material 118, the slope of the ground, etc.), screed 106 will settle to a constant steady state angle of attack θA. As asphalt paver 100 moves forward, trailing edge 120 begins to rise due to the increased pressure built up under screed 106. As trailing edge 120 slowly rises, angle of attack θA reduces until a new steady state angle of attack θA is reached. In some embodiments, the steady state angle of attack θA will tend to remain relatively constant, such that a change in tow point height 122 will eventually (after a few tow arm lengths of travel distance) result in a corresponding change in mat thickness 124 (i.e., height of trailing edge 120) of the same or similar magnitude. A similar effect can be observed when tow point cylinder 164 is lowered—the resulting mat thickness 124 will eventually be reduced by the same or similar magnitude once screed 106 settles to a steady state after moving some distance forward.

Asphalt paver 100 is designed in such a way that in the absence of any tow point height control, the action of screed 106 will still result in a much smoother surface than the underlying terrain. The "smoothing" effect relies to a large degree on tow points 112 remaining at a constant height. By positioning tow points 112 at a midpoint between the wheels (or tracks) of tractor 102, the "rocking" effect of tractor 102 as it traverses small humps and hollows in the terrain is significantly reduced. However, if tractor 102 travels over humps or hollows that are larger than the track length, tow points 112 will rise and fall accordingly. In some instances, an automatic tow point height control system has been implemented to reduce vertical tow point movement due to uneven terrain.

Figure 3A:
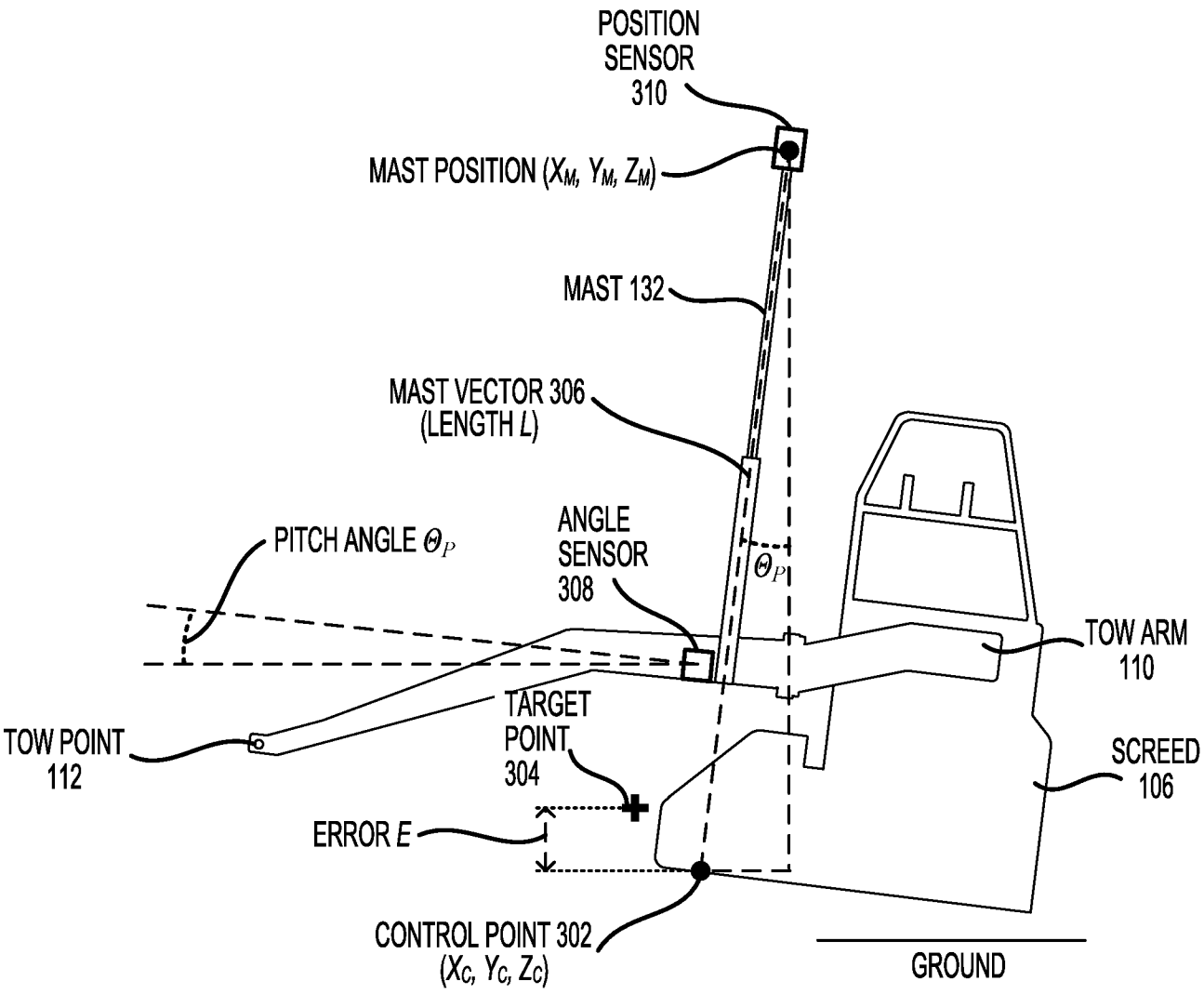
FIG. 3A illustrates a side view of various components of an asphalt paver showing an example operation for controlling the asphalt paver.

FIG. 3A illustrates a side view of various components of asphalt paver 100 showing an example operation for controlling asphalt paver 100, in accordance with some embodiments of the present invention. Specifically, FIG. 3A illustrates an example technique for calculating a control point 302 and thereafter causing movement of tow arm 110. In the illustrated embodiment, control point 302 is set at a position along a bottom surface of screed 106 at which a mast vector 306 formed by a lengthwise extension of mast 132 intersects with the bottom surface of screed 106. Mast vector 306 may run parallel to mast 132 and may run along the center of mast 132, extending downward beyond the bottom end of mast 132. A geospatial position ($X_M$, $Y_M$, $Z_M$) of mast 132 (alternatively referred to as the mast position) may be detected using a position sensor 310 mounted to mast 132. A length L of mast vector 306 may be constant and predetermined by measuring the distance between position sensor 310 and control point 302. A pitch angle $\theta_P$ and/or a roll angle $\theta_R$ associated with mast 132 may be detected using an angle sensor 308. Control point 302 may then be calculated based on geospatial position ($X_M$, $Y_M$, $Z_M$) of mast 132, length L, and pitch angle $\theta_P$ and/or roll angle $\theta_R$ by, for example, determining a direction of mast vector 306 (using pitch angle $\theta_P$ and/or roll angle $\theta_R$) and adding/subtracting mast vector 306 to/from geospatial position ($X_M$, $Y_M$, $Z_M$) of mast 132.

Position sensor 310 may be mounted to an upper end of mast 132. Position sensor 310 may employ one or more of various positioning technologies. For example, position sensor 310 may include a Global Navigation Satellite System (GNSS) receiver. In some embodiments, position sensor 310 may include a total station device that can establish a direct line of sight with a second nearby device to enable laser communication for detecting the geospatial position. For example, position sensor 310 may include a laser receiver, a laser transmitter, and/or a laser reflector that is used to detect the geospatial position. Although geospatial position ($X_M$, $Y_M$, $Z_M$) of mast 132 is shown as being a 3D coordinate, in various embodiments, the geospatial position may be a 2D coordinate or a 1D coordinate (e.g., an elevation).

An angle sensor 308 may be mounted in any one of various positions along asphalt paver 100 so as to detect pitch angle $\theta_P$ and/or roll angle $\theta_R$. For example, in various embodiments, angle sensor 308 may be mounted to tow arm 110, mast 132, or screed 106. In some embodiments, angle sensor 308 may be mounted to any surface that is rigidly connected to mast 132 such that rotation of angle sensor 308 is indicative of rotation of mast 132. In some embodiments, angle sensor 308 may include a dual axis tilt sensor. In some embodiments, angle sensor 308 may include an inertial measurement unit (IMU).

Before, after, or concurrently with calculating control point 302, a target point 304 to which control point 302 is compared may be calculated. In some embodiments, target point 304 may correspond to an expected or desired position of control point 302 for controlling asphalt paver 100 in a desired way. In some embodiments, a control system may attempt to drive control point 302 toward target point 304 by causing movement of tow arm 110. For example, the control system may calculate an error E between control point 302 and target point 304 and may cause movement of tow arm 110 based on error E. Error E may be an elevation offset, a vertical offset, a horizontal offset, a distance between two points, or some calculation based on any of these quantities, among other possibilities. For example, error E may be calculated as the difference between the elevations of control point 302 and target point 304, the square of the difference between the elevations, the magnitude of the difference between the elevations, among other possibilities.

In the illustrated embodiment, the control system may calculate the error E, indicating that control point 302 is lower than target point 304. In response, the control system may cause tow point 112 for tow arm 110 to raise by some determined amount, e.g., a few centimeters, by retracting tow point cylinder 164. The control system may cause tow point cylinder 164 to retract by the determined amount almost immediately or over some period of time, e.g., a few seconds. For example, the control system may cause tow point cylinder 164 to retract linearly by the determined amount over 2 seconds.

Figure 3B:
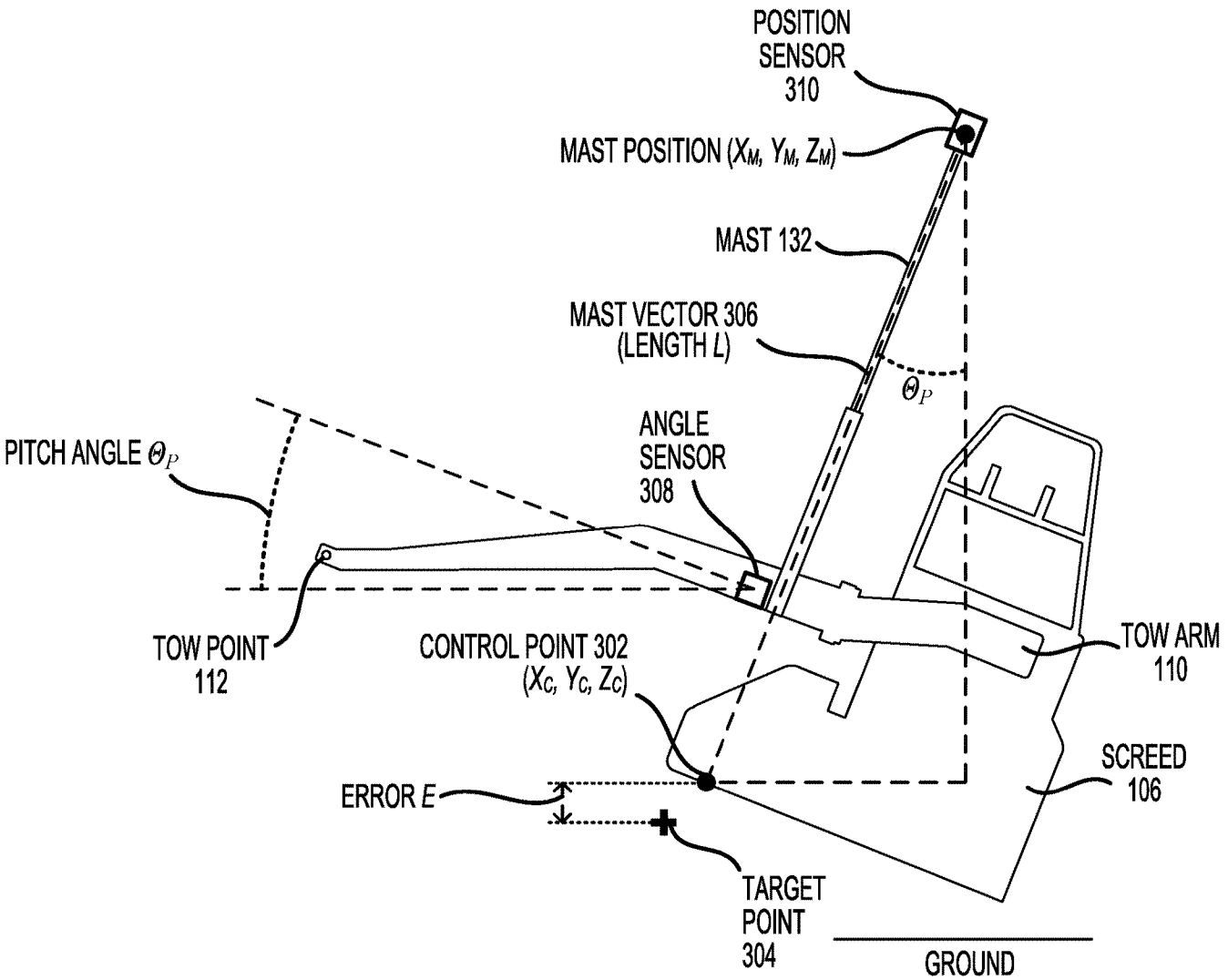
FIG. 3B illustrates a side view of various components of an asphalt paver showing an example operation for controlling the asphalt paver following the example operation illustrated in FIG. 3A.

FIG. 3B illustrates a side view of various components of asphalt paver 100 showing an example operation for controlling asphalt paver 100 following the example operation illustrated in FIG. 3A. Specifically, FIG. 3B illustrates an example technique for recalculating control point 302 and thereafter causing movement of tow arm 110. After tow point cylinder 164 has been retracted and tow point 112 has been raised, both geospatial position ($X_M$, $Y_M$, $Z_M$) of mast 132 and pitch angle $\theta_P$ have changed. Specifically, pitch angle $\theta_P$ has increased considerably due to the rotation of tow arm 110 to which angle sensor 308 is mounted.

In some embodiments, upon determining that tow point cylinder 164 has finished its retraction, the control system may trigger position sensor 310 and angle sensor 308 to detect new data. Position sensor 310 may then detect a new geospatial position ($X_M$, $Y_M$, $Z_M$) of mast 132 and angle sensor 308 may detect a new pitch angle $\theta_P$ and/or a new roll angle $\theta_R$. Control point 302 may then be recalculated based on the new data in the same manner as described above. Target point 304 may remain the same as in FIG. 3A or may be recalculated if new user input is received or if the control scheme causes a modification to target point 304.

In the illustrated embodiment, the control system may calculate the error E, indicating that control point 302 is higher than target point 304. In other words, the control system has caused control point 302 to overshoot target point 304. In response, the control system may cause tow point 112 for tow arm 110 to lower by some determined amount by extending tow point cylinder 164. The control system may cause tow point cylinder 164 to lower by the determined amount almost immediately or over some period of time.

Figure 4A:
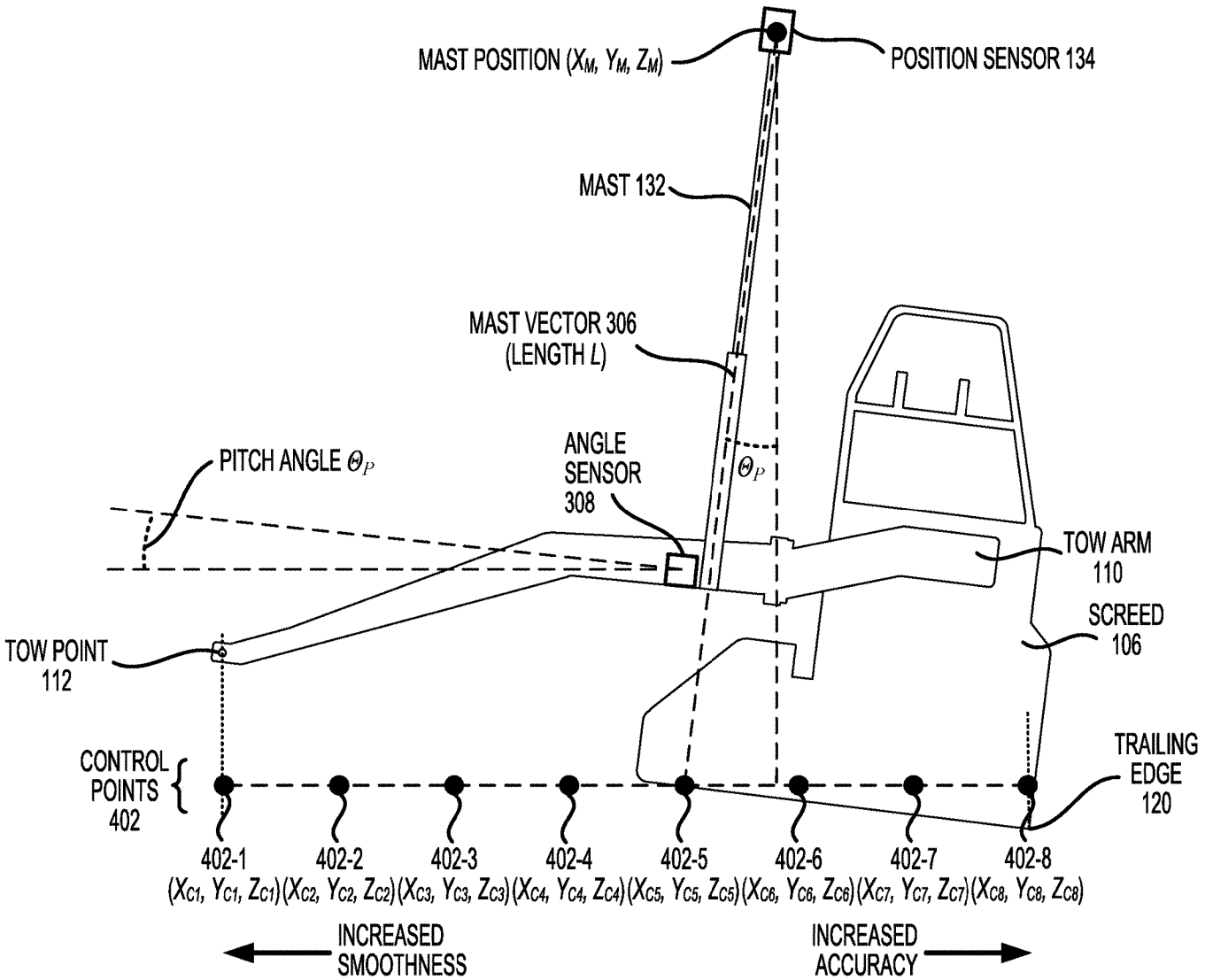
FIG. 4A illustrates a side view of various components of an asphalt paver showing various control points that may be calculated.

FIG. 4A illustrates a side view of various components of asphalt paver 100 showing various control points 402 that may be calculated for controlling asphalt paver 100. While control point 402-5 is aligned with mast vector 306, each of controls points 402-1 to 402-4 and 402-6 to 402-8 are spatially offset from mast vector 306 in the longitudinal direction. Each of control points 402 offer differing amounts of smoothness and accuracy based on the distance from the rear of screed 106. For example, control point 402-1, which is illustrated as being vertically aligned with tow point 112, offers the most smoothness and the least accuracy, and control point 402-8, which is illustrated as being vertically aligned with trailing edge 120, offers the most accuracy and the least smoothness.

Control points 402-1 to 402-4 and 402-6 to 402-8 may be calculated based on a previously calculated control point 402-5 using an offset distance from mast vector 306 or may be directly calculated using geospatial position ($X_M$, $Y_M$, $Z_M$) of mast 132, length L, pitch angle $\theta_P$, and the offset distance from mast vector 306. The offset distance may be the distance in the longitudinal direction that the particular control point is spatially offset from mast vector 306. For example, the offset distance for control point 402-1 is greater than the offset distance for control point 402-2, which is greater than the offset distance for control point 403-3, which is greater than the offset distance for control point 403-4.

In some embodiments, a user may specify a desired level of smoothness or a desired level or accuracy, and one of control points 402 may be selected automatically by the control system in accordance with the desired level. The user may specify the desired level prior to or during performance of a paving operation. In one example, the user may specify a desired level of smoothness prior to paving a first section of a surface, and may change the desired level of smoothness prior to paving a second section of the surface, causing the control point to automatically adjust between the first and second sections. In another example, a user may begin a paving operation by selecting and calculating control point 408-7 to achieve higher accuracy, and then may thereafter, during the paving operation, switch to and calculate control point 402-2 to achieve higher smoothness. In some embodiments, the control system may repeatedly adjust the control point in the forward and/or backward longitudinal direction during a paving operation to achieve a constant smoothness to compensate for the varying smoothness of the ground. For example, the control system may adjust the control point in the forward longitudinal direction when asphalt paver 100 passes over uneven ground and may subsequently adjust the control point in the backward longitudinal direction when asphalt paver 100 passes over smoother ground. In such embodiments, when the control system sets a new control point, the target point may accordingly be adjusted and calculated based on the new control point.

Figure 4B:
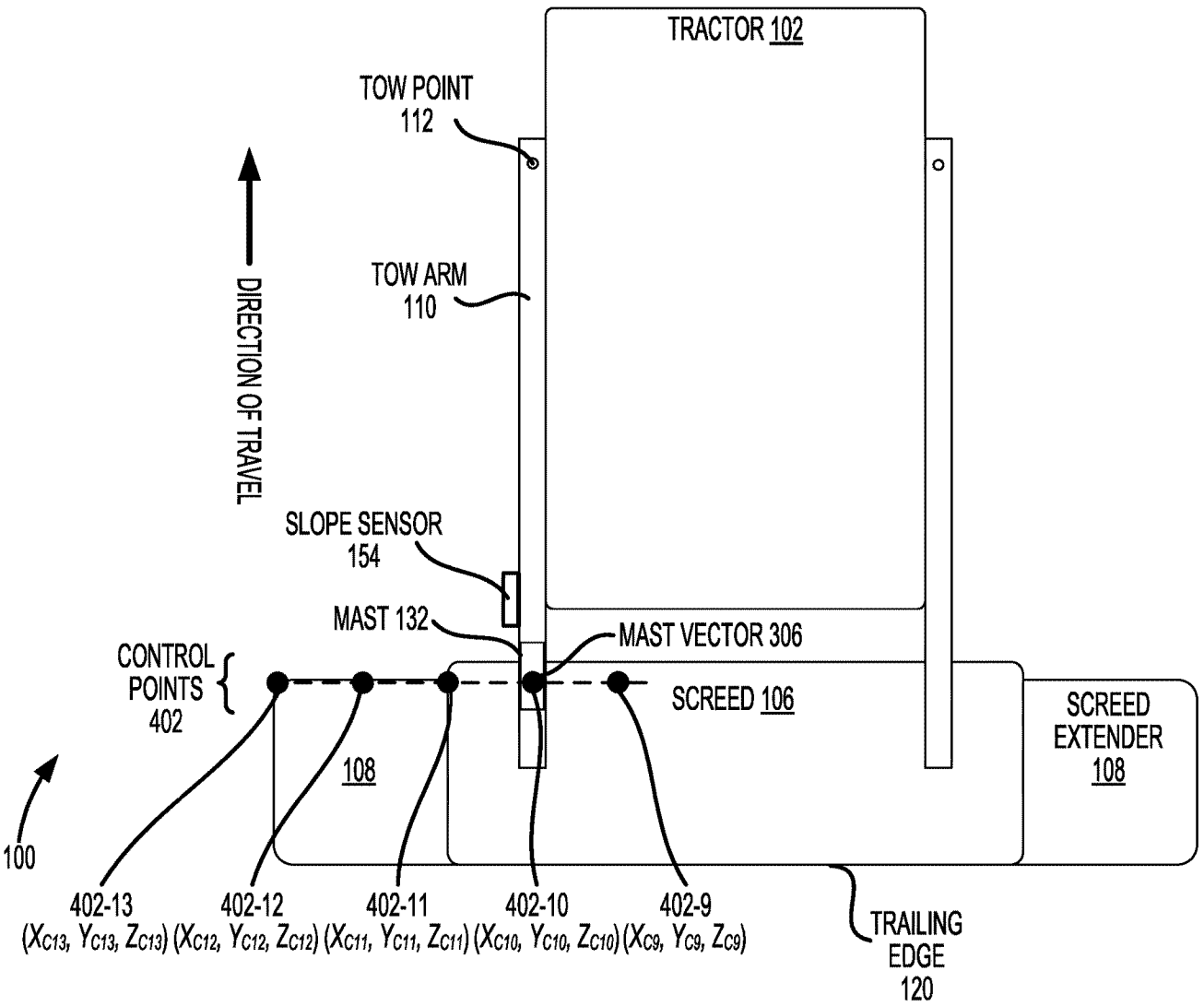
FIG. 4B illustrates a top view of an asphalt paver showing various control points that may be calculated.

FIG. 4B illustrates a top view of asphalt paver 100 showing various control points 402 that may be calculated for controlling asphalt paver 100. While control point 402-10 is aligned with mast vector 306, each of controls points 402-9 and 402-11 to 402-13 are spatially offset from mast vector 306 in the transverse direction. By adjusting the control point in the transverse direction, asphalt paver 100 may be responsive to different sections of the ground beneath screed 106 and/or screed extender 108. For example, in some embodiments, improved smoothness and/or accuracy may be achieved when the control point is adjusted to be near the transverse edge of screed 106 and/or screed extender 108 without being outside of the transverse edge. In such embodiments, it may be beneficial to adjust the control point to be near the edge of screed extender 108 when screed extender 108 is extended.

Figure 5A:
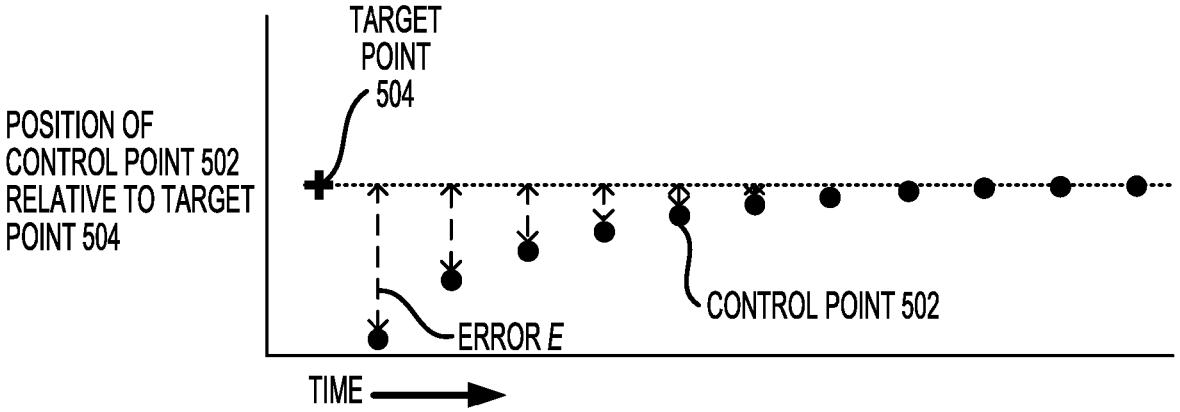
FIG. 5A illustrates a plot showing the position of a control point relative to the position of a target point as a function of time.
Figure 5B:
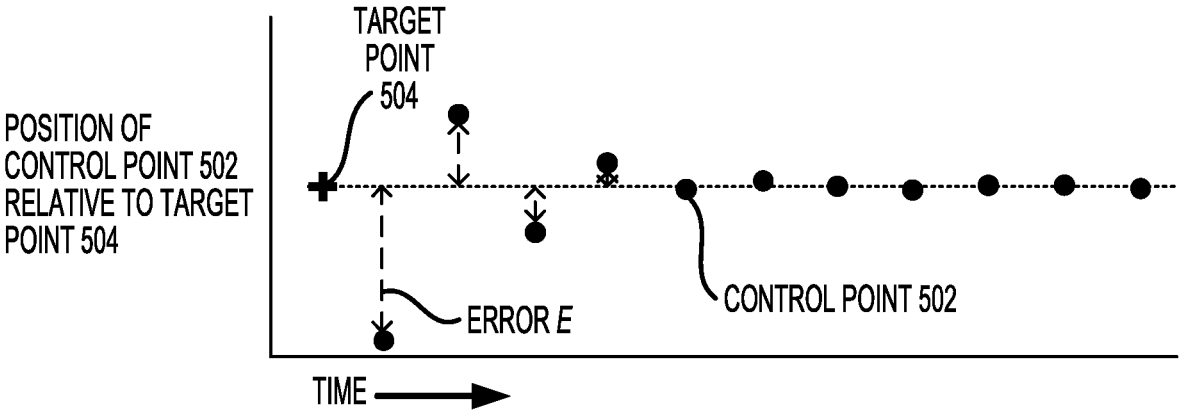
FIG. 5B illustrates a plot showing the position of a control point relative to the position of a target point as a function of time.

FIGS. 5A and 5B illustrates a plot showing the position of a control point 502 relative to the position of target point 504 as a function of time. FIG. 5A corresponds to a first scenario in which control point 502 is set and calculated to be offset from mast vector 306 in the forward longitudinal direction (e.g., control point 402-1) to achieve higher smoothness. FIG. 5B corresponds to a second scenario in which control point 502 is set and calculated to be offset from mast vector 306 in the backward longitudinal direction (e.g., control point 402-8) to achieve higher accuracy.

In reference to FIG. 5A, after control point 502 is first calculated, control point 502 is compared to target point 504 to calculate error E that is shown to be large. The control system then causes tow point cylinder 164 to lift tow point 112 in order to drive control point 502 toward target point 504. Slowly and over a period of time, control point 502 is driven toward target point 504, causing error E to slowly decrease.

In reference to FIG. 5B, the control system similarly causes tow point cylinder 164 to lift tow point 112 in order to drive control point 502 toward target point 504. However, target point 504 is overshot due to control point 502 experiencing little change when tow point cylinder 164 is actuated. After control point 502 is again recalculated and the control system lowers tow point 112 in order to drive control point 502 downward toward target point 504, target point is again overshot. Over time, error E slowly decreases as control point 502 is driven toward target point 504.

Figure 6:
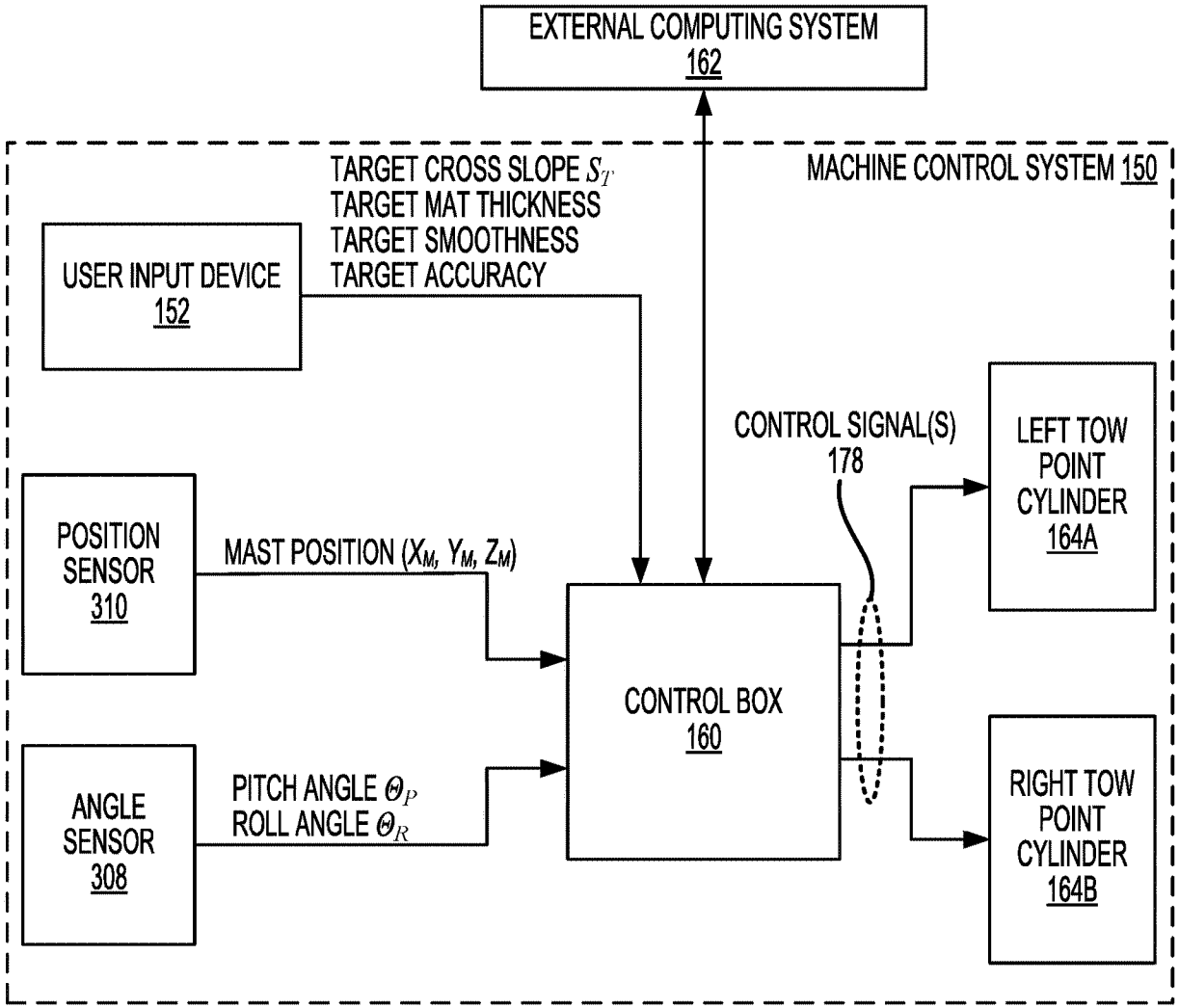
FIG. 6 illustrates various components of a machine control system.

FIG. 6 illustrates a machine control system 150, according to some embodiments of the present invention. Machine control system 150 includes various sensors, input devices, actuators, and processors for allowing one or more operators of asphalt paver 100 to complete a high-precision paving operation. The components of machine control system 150 may be mounted to or integrated with the components of asphalt paver 100 such that asphalt paver 100 may include all or portions of machine control system 150. The components of machine control system 150 may be communicatively coupled to each other via one or more wired and/or wireless connections.

Machine control system 150 may include a control box 160 that receives data from the various sensors and inputs and generates commands that are sent to the various actuators and output devices. Control box 160 may include one or more processors and an associated memory. In some embodiments, control box 160 may be communicatively coupled to a external computing system 162 located external to machine control system 150 and asphalt paver 100. External computing system 162 may send instructions to control box 160 of the details of a paving operation, such as an area to be paved, a desired asphalt thickness, a desired grading, etc. External computing system 162 may also send alerts and other general information to control box 160, such as traffic conditions, weather conditions, the location and status of material transfer vehicles, and the like.

In some embodiments, machine control system 150 includes a user input device 152 for receiving various user inputs and sending the inputs to control box 160. The user input may include a target/desired cross slope ST of screed 106, a target/desired mat thickness, a target/desired smoothness, a target/desired accuracy, among other possibilities. User input device 152 may be a keyboard, a touchscreen, a touchpad, a switch, a lever, a button, a steering wheel, an acceleration pedal, a brake pedal, among other possibilities. User input device 152 may be mounted to tractor 102, hopper 104, screed 106, or any other physical part of asphalt paver 100. In one implementation, user input device 152 may be a computing device mounted vertically to an outer edge of screed extender 108, allowing an operator of asphalt paver 100 to walk alongside the construction machine during a paving operation. User input device 152 may further receive user inputs indicating a desired movement of tractor 102, a desired movement of screed 106, a desired width of screed 106, and the like.

In some embodiments, machine control system 150 includes position sensor 310 that is configured to send geospatial position ($X_M$, $Y_M$, $Z_M$) of mast 132 to control box 160 and angle sensor 308 that is configured to send pitch angle $\theta_P$ and/or a roll angle $\theta_R$ associated with mast 132 to control box 160. In some embodiments, position sensor 310 may send data that directly includes geospatial position ($X_M$, $Y_M$, $Z_M$) of mast 132 or, in some embodiments, may send raw data that is processed by control box 160 to generate geospatial position ($X_M$, $Y_M$, $Z_M$) of mast 132. In some embodiments, angle sensor 308 may send data that directly includes pitch angle $\theta_P$ and/or roll angle $\theta_R$ or, in some embodiments, may send raw data that is processed by control box 160 to generate pitch angle $\theta_P$ and/or roll angle $\theta_R$.

In some embodiments, control box 160 includes a processor that calculates the control point and the target point, and an error based on a comparison between them as described herein. Control box then causes movement of tow point cylinders 164 based on the error/comparison by outputting one or more control signal(s) 178 to tow point cylinders 164. Control signal(s) 178 may include direct current (DC) or alternating current (AC) voltage signals, DC or AC current signals, information-containing signals, Ethernet signals, and/or controller area network (CAN) signals.

Figure 7:
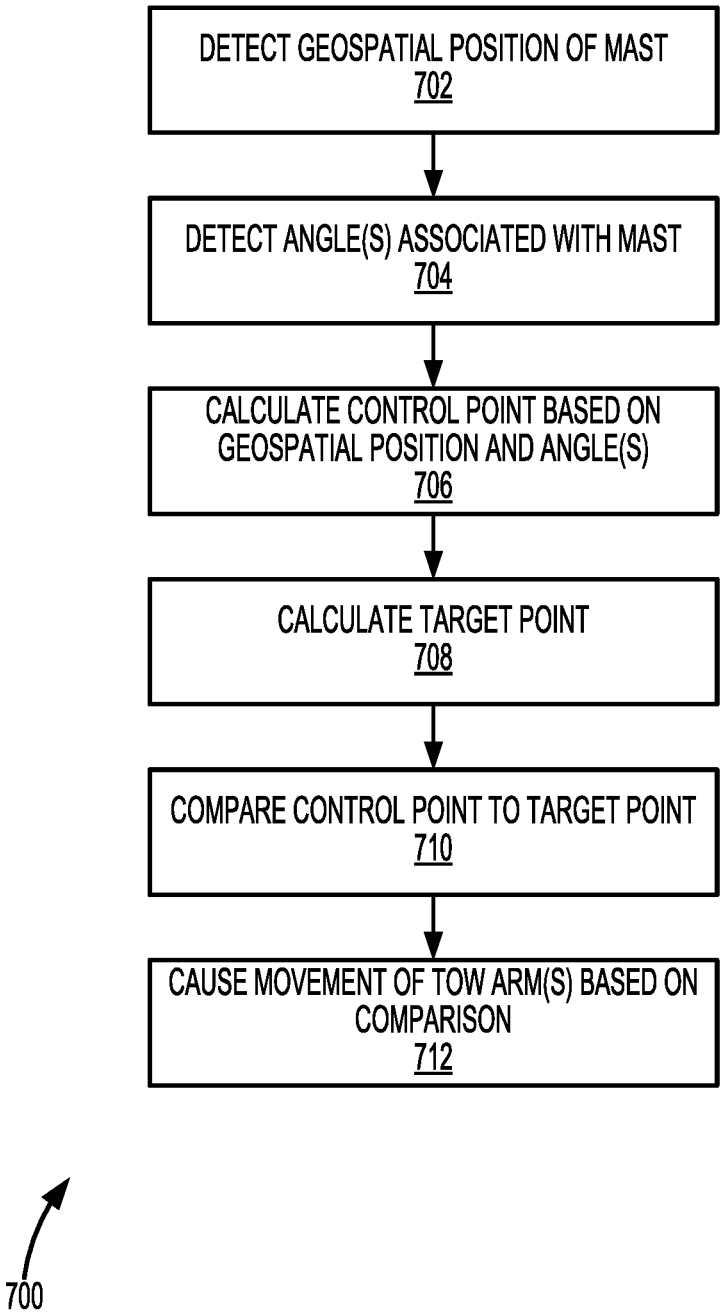
FIG. 7 illustrates a method of controlling a construction machine, such as an asphalt paver.

FIG. 7 illustrates a method 700 of controlling a construction machine (e.g., asphalt paver 100), according to some embodiments of the present invention. The construction machine may include a tractor (e.g., tractor 102), an implement (e.g., screed 106) coupled to the tractor via at least one tow arm (e.g., tow arm 110), and a mast (e.g., mast 132). One or more steps of method 700 may be performed in a different order than that shown in the illustrated embodiment, and one or more steps of method 700 may be omitted during performance of method 700.

At step 702, a geospatial position (e.g., mast position ($X_M$, $Y_M$, $Z_M$)) is detected. The geospatial position may correspond to the mast and/or to the construction machine. The geospatial position may be a 1D, 2D, and/or 3D coordinate. The mast may be mounted to the construction machine. The geospatial position may be detected by a position sensor (e.g., position sensor 310). The position sensor may be mounted to an upper end of the mast. The geospatial position may be sent by the position sensor and received by a control box (e.g., control box 160) or by an external computing system (e.g., external computing system 162).

At step 704, at least one angle associated with the mast is detected. The at least one angle may include a pitch angle (e.g., pitch angle $\theta_P$) and/or a roll angle (e.g., roll angle $\theta_R$). The at least one angle may be detected by an angle sensor (e.g., angle sensor 308). The angle sensor may be mounted to the implement, the at least one tow arm, or the mast. The angle sensor may be integrated with the position sensor or may be a separate device. The angle sensor may include an IMU. The at least one angle may be sent by the angle sensor and received by the control box or by an external computing system.

At step 706, a control point (e.g., control points 302, 402, or 502) is calculated based on the geospatial position and the at least one angle. The control point may be spatially offset from a vector (e.g., mast vector 306) formed by a lengthwise extension of the mast. For example, the control point may be spatially offset from the vector in the longitudinal direction with respect to the construction machine or in the transverse direction with respect to the construction machine. The control point may be 1D, 2D, or 3D. The control point may be calculated by the control box or by an external computing system.

At step 708, a target point (e.g., target points 304, 404, or 504) is calculated. The target point may be calculated based on a user input received via a user input device (e.g., user input device 152). The target point may be 1D, 2D, or 3D. The target point may correspond to a desired position or value of control point 302. The target point may be calculated by the control box or by an external computing system.

At step 710, the control point is compared to the target point. Comparing the control point to the target point may include calculating an error (e.g., error E) between the control point and the target point. The control point may be compared to the target point by the control box or by an external computing system.

At step 712, the at least one tow arm is caused to move based on the comparison performed at step 710. The at least one tow arm may be caused to move based on the error. For example, the amount to which the at least one tow arm is caused to move may be proportional to the magnitude of the error. Causing the movement of the at least one tow arm may include generating and sending a control signal (e.g., control signal 178) to an actuator (e.g., tow point cylinder 164) coupled to the at least one tow arm. The control signal may be generated by the control box. The at least one tow arm may include a left tow arm coupled to a left tow point cylinder at a forward end of the left tow arm and to the implement at a rear end of the left tow arm, and a right tow arm coupled to a right tow point cylinder at a forward end of the right tow arm and to the implement at a rear end of the right tow arm. One or both of the tow point cylinders may be retracted or extended to cause one or both of the tow arms to move.

Figure 8:
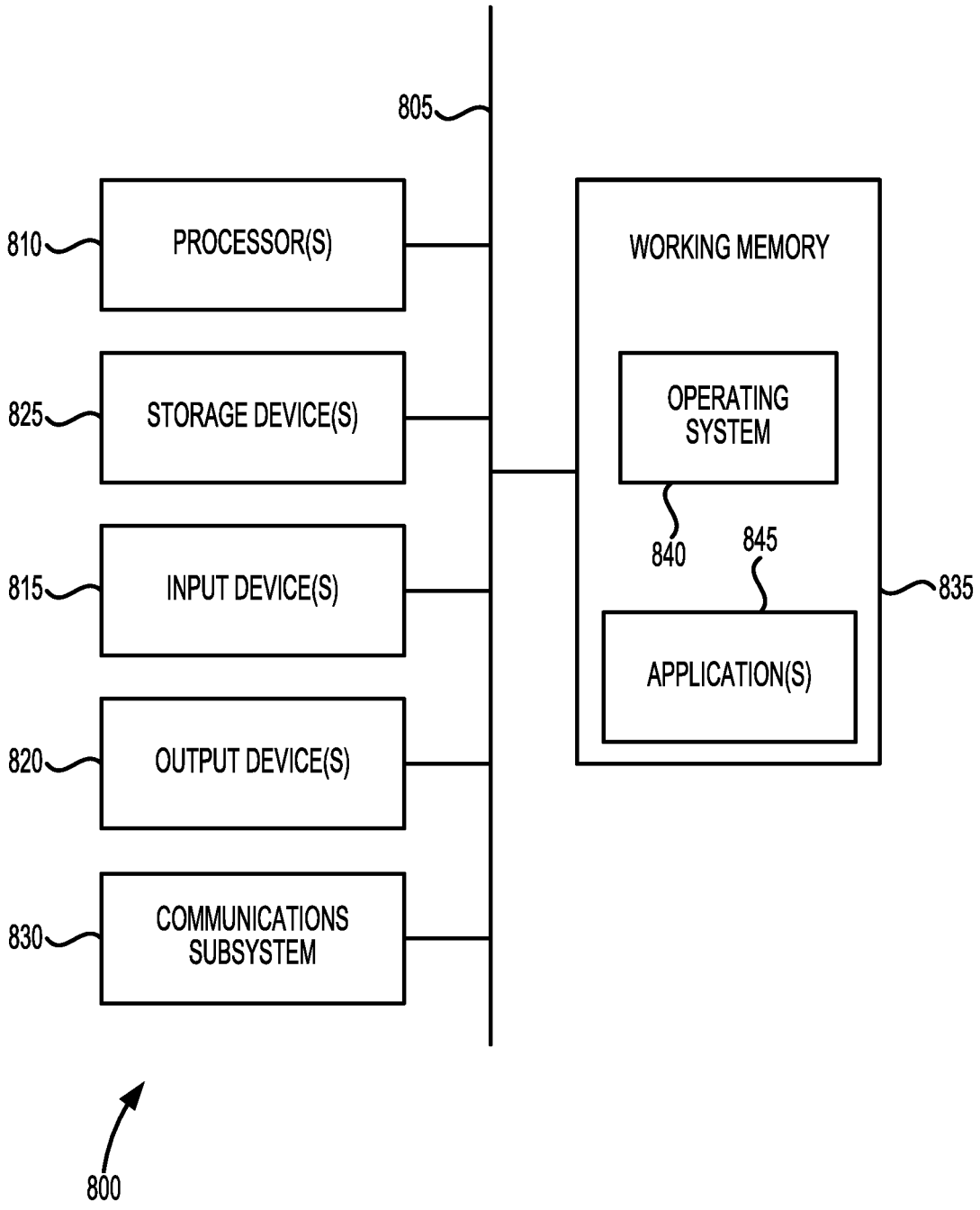
FIG. 8 illustrates a simplified computer system.

FIG. 8 illustrates a simplified computer system 800, according to some embodiments of the present invention. Computer system 800 as illustrated in FIG. 8 may be incorporated into devices such as control box 160, external computing system 162, user input device 152, position sensor 310, angle sensor 308, or some other device described herein. FIG. 8 provides a schematic illustration of one embodiment of computer system 800 that can perform some or all of the steps of the methods provided by various embodiments. It should be noted that FIG. 8 is meant only to provide a generalized illustration of various components, any or all of which may be utilized as appropriate. FIG. 8, therefore, broadly illustrates how individual system elements may be implemented in a relatively separated or more integrated manner.

Computer system 800 is shown comprising hardware elements that can be electrically coupled via a bus 805, or may otherwise be in communication, as appropriate. The hardware elements may include one or more processors 810, including without limitation one or more general-purpose processors and/or one or more special-purpose processors such as digital signal processing chips, graphics acceleration processors, and/or the like; one or more input devices 815, which can include, without limitation a mouse, a keyboard, a camera, and/or the like; and one or more output devices 820, which can include, without limitation a display device, a printer, and/or the like.

Computer system 800 may further include and/or be in communication with one or more non-transitory storage devices 825, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

Computer system 800 might also include a communications subsystem 830, which can include, without limitation a modem, a network card (wireless or wired), an infrared communication device, a wireless communication device, and/or a chipset such as a Bluetooth™ device, an 802.11 device, a WiFi device, a WiMax device, cellular communication facilities, etc., and/or the like. The communications subsystem 830 may include one or more input and/or output communication interfaces to permit data to be exchanged with a network such as the network described below to name one example, to other computer systems, and/or any other devices described herein. Depending on the desired functionality and/or other implementation concerns, a portable electronic device or similar device may communicate image and/or other information via the communications subsystem 830. In other embodiments, a portable electronic device, e.g. the first electronic device, may be incorporated into computer system 800, e.g., an electronic device as an input device 815. In some embodiments, computer system 800 will further comprise a working memory 835, which can include a RAM or ROM device, as described above.

Computer system 800 also can include software elements, shown as being currently located within the working memory 835, including an operating system 840, device drivers, executable libraries, and/or other code, such as one or more application programs 845, which may comprise computer programs provided by various embodiments, and/or may be designed to implement methods, and/or configure systems, provided by other embodiments, as described herein. Merely by way of example, one or more procedures described with respect to the methods discussed above can be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 825 described above. In some cases, the storage medium might be incorporated within a computer system, such as computer system 800. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by computer system 800 and/or might take the form of source and/or installable code, which, upon compilation and/or installation on computer system 800 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware or software including portable software, such as applets, etc., or both. Further, connection to other computing devices such as network input/output devices may be employed.

As mentioned above, in one aspect, some embodiments may employ a computer system such as computer system 800 to perform methods in accordance with various embodiments of the technology. According to a set of embodiments, some or all of the procedures of such methods are performed by computer system 800 in response to processor 810 executing one or more sequences of one or more instructions, which might be incorporated into the operating system 840 and/or other code, such as an application program 845, contained in the working memory 835. Such instructions may be read into the working memory 835 from another computer-readable medium, such as one or more of the storage device(s) 825. Merely by way of example, execution of the sequences of instructions contained in the working memory 835 might cause the processor(s) 810 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using computer system 800, various computer-readable media might be involved in providing instructions/code to processor(s) 810 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 825. Volatile media include, without limitation, dynamic memory, such as the working memory 835.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 810 for execution. Merely by way of example, the instructions may initially be carried on a magnetic disk and/or optical disc of a remote computer. A remote computer might load the instructions into its dynamic memory and send the instructions as signals over a transmission medium to be received and/or executed by computer system 800.

The communications subsystem 830 and/or components thereof generally will receive signals, and the bus 805 then might carry the signals and/or the data, instructions, etc. carried by the signals to the working memory 835, from which the processor(s) 810 retrieves and executes the instructions. The instructions received by the working memory 835 may optionally be stored on a non-transitory storage device 825 either before or after execution by the processor(s) 810.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a schematic flowchart or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A construction machine comprising:

a tractor;

an implement coupled to the tractor via at least one tow arm;

a mast mounted to the implement or to the at least one tow arm;

a position sensor mounted to the mast and configured to detect a geospatial position;

an angle sensor configured to detect at least one angle associated with the mast; and one or more processors configured to perform operations comprising:

calculating a control point based on the geospatial position and the at least one angle, wherein the control point is spatially offset by an offset distance from a vector formed by a lengthwise extension of the mast;

causing movement of the at least one tow arm to drive the control point toward a target point; and during operation of the construction machine, adjusting the control point in a forward or a backward longitudinal direction of the construction machine so as to increase or decrease the offset distance.

2. The construction machine of claim 1, wherein:

the construction machine is an asphalt paver; and the implement is a screed.

3. The construction machine of claim 1, wherein the angle sensor is mounted to the implement, the at least one tow arm, or the mast.

4. The construction machine of claim 1, wherein the at least one angle includes one or both of a pitch angle and a roll angle.

5. The construction machine of claim 1, wherein the operations further comprise:

receiving user input via a user input device; and calculating the target point based on the user input.

6. The construction machine of claim 1, wherein the operations further comprise:

comparing the control point to the target point; and calculating an error based on a comparison between the control point and the target point, wherein the at least one tow arm is caused to move based on the error.

7. The construction machine of claim 1, wherein, prior to adjusting the control point, the control point is spatially offset from the vector in one or both of a longitudinal direction of the construction machine or a transverse direction of the construction machine.

8. The construction machine of claim 1, wherein causing the movement of the at least one tow arm includes:

generating and sending a control signal to one or both of a left tow point cylinder coupled to a left tow arm of the at least one tow arm and a right tow point cylinder coupled to a right tow arm of the at least one tow arm.

9. The construction machine of claim 8, wherein:

the left tow arm is coupled to the left tow point cylinder at a forward end of the left tow arm and to the implement at a rear end of the left tow arm; and the right tow arm is coupled to the right tow point cylinder at a forward end of the right tow arm and to the implement at a rear end of the right tow arm.

10. A machine control system comprising:

a position sensor configured to be mounted to a mast of a construction machine and to detect a geospatial position;

an angle sensor configured to detect at least one angle associated with the mast; and one or more processors configured to perform operations comprising:

calculating a control point based on the geospatial position and the at least one angle, wherein the control point is spatially offset by an offset distance from a vector formed by a lengthwise extension of the mast;

causing movement of at least one tow arm of the construction machine to drive the control point toward a target point; and during operation of the construction machine, adjusting the control point in a forward or a backward longitudinal direction of the construction machine so as to increase or decrease the offset distance.

11. The machine control system of claim 10, wherein the construction machine is an asphalt paver.

12. The machine control system of claim 10, wherein the angle sensor is configured to mount to the mast, the at least one tow arm, or an implement of the construction machine.

13. The machine control system of claim 10, wherein the at least one angle includes one or both of a pitch angle and a roll angle.

14. The machine control system of claim 10, wherein the operations further comprise:

receiving user input via a user input device; and calculating the target point based on the user input.

15. The machine control system of claim 10, wherein the operations further comprise:

comparing the control point to the target point; and calculating an error based on a comparison between the control point and the target point, wherein the at least one tow arm is caused to move based on the error.

16. The machine control system of claim 10, wherein, prior to adjusting the control point, the control point is spatially offset from the vector in one or both of a longitudinal direction of the construction machine or a transverse direction of the construction machine.

17. A method comprising:

detecting, by a position sensor mounted to a mast of a construction machine, a geospatial position;

detecting, by an angle sensor, at least one angle associated with the mast;

calculating a control point based on the geospatial position and the at least one angle, wherein the control point is spatially offset by an offset distance from a vector formed by a lengthwise extension of the mast;

causing movement of at least one tow arm of the construction machine to drive the control point toward a target point; and during operation of the construction machine, adjusting the control point in a forward or a backward longitudinal direction of the construction machine so as to increase or decrease the offset distance.

18. The method of claim 17, wherein the at least one angle includes one or both of a pitch angle and a roll angle.

19. The method of claim 17, further comprising:

receiving user input via a user input device; and calculating the target point based on the user input.

20. The method of claim 17, further comprising:

comparing the control point to the target point; and calculating an error based on a comparison between the control point and the target point, wherein the at least one tow arm is caused to move based on the error.

* * * * *